United States Patent [19]

Wilkinson

[11] 4,175,849

[45] Nov. 27, 1979

[54] PHOTOGRAPHIC DRUM PROCESSOR INSERTS

[75] Inventor: Peter R. S. Wilkinson, Chessington, England

[73] Assignee: Wilkinson Photographic Products Limited, England

[21] Appl. No.: 801,252

[22] Filed: May 27, 1977

[30] Foreign Application Priority Data

May 28, 1976 [GB] United Kingdom ..... 22373/76

[51] Int. Cl.[2] ..... G03D 3/10

[52] U.S. Cl. ..... 354/329; 354/337; 354/344; 134/142; 134/157

[58] Field of Search ..... 354/312, 315, 328, 329, 354/330, 331, 333, 335, 336, 337, 338, 340, 342, 343, 344, 345; 134/137, 140, 142, 149, 153, 157, 158, 159, 160

[56] References Cited

U.S. PATENT DOCUMENTS

| | | | |
|---|---|---|---|
| 1,979,106 | 10/1934 | Henderson | 354/342 |
| 3,304,850 | 2/1967 | Gall | 354/329 |
| 3,359,880 | 12/1967 | Huss | 354/329 |
| 3,813,684 | 5/1974 | Ramsdale | 354/329 |
| 3,938,171 | 2/1976 | Masygan | 354/329 |

*Primary Examiner*—L. T. Hix
*Assistant Examiner*—Alan Mathews
*Attorney, Agent, or Firm*—Leydig, Voit, Osann, Mayer & Holt, Ltd.

[57] ABSTRACT

A drum processor insert for use in the drum of a photographic drum processor is described which enables the capacity of the processor to be substantially increased. The insert comprises a plurality of arcuate holders each adapted to hold a sheet of photographically sensitized material, and a frame, each holder being rotatably mounted on the frame so that it is swingable about an axis, parallel to the edges of the arcuate holder, from a closed position in which the frame and holders constitute a substantially cylindrical shape which fits in the drum with the edges of the holders at the periphery of the drum, and an open position in which a sheet of photographically sensitized material can be loaded into or unloaded from each holder.

8 Claims, 3 Drawing Figures

PHOTOGRAPHIC DRUM PROCESSOR INSERTS

This invention relates to photographic drum processor inserts.

In recent years, there has been developed a variety of so-called photographic drum processors. In such apparatus, photographically sensitised material to be processed is located, usually arcuately, about the inner wall of a drum. A small quantity of processing liquid is introduced into the drum and the drum, with its axis horizontal, is rotated to pass the processing liquid over the surface of the photographically sensitised material to be treated.

A wide variety of such drums has been developed and is available in commerce both for the amateur photographic market and for the professional market. Drum processors have the advantage of requiring only a small quantity of processing solution and a number of other advantages in use. However, they have the disadvantage that they generally take only one or a small number of sheets of sensitised photographic material at any one time. Accordingly, processing a large quantity of sensitised material can take a substantial lenth of time, particularly if only one drum is available for use.

According to the present invention there is provided a drum processor insert comprising a plurality of arcuate holders each adapted to hold a sheet of photographically sensitised material, each holder being rotatably mounted on a frame so that it is swingable about an axis, all such axes being parallel and being parallel to the edges of the arcuate holder, from a closed position in which the frame and holders constitute a substantially cylindrical shape, the edges of the holders being distributed about the periphery of the cylinder, and an open position in which the face of each holder adapted to receive a sheet of photographically sensitised material can be reached.

The preferred form of construction for the frame is a central axially extending member on each end of which is a spider having a number of equiangularly spaced arms. Each arm may bear a pivot, each holder being swingably mounted between two such pivots on oppositely facing arms.

Preferably one end of the frame bears means identifying it from the other end of the frame, most preferably by feel, and means to ensure that the holders may be demounted from and remounted on the frame in only one orientation. This may easily be achieved by making the arms of the spider resilient so that they may be sprung apart to release the swingable holders.

Preferably each holder consists of a substantially cylindrical trough having at either side a holding strip. The dimensions of the trough and space between the holding strips should be so chosen that a sheet of standard sized photographically sensitised material, e.g. a 10"×8" sheet of photographic paper may be flexed into position between the side strips and will hold there in position by virtue of its resilience which will attempt to return it to a flat sheet shape.

Means may be provided at the ends of each arcuate holder to prevent sheets of photographically sensitised material slipping out axially and the holder may additionally be provided with one or more through holes enabling a user of the device to remove a sheet in the holder by pushing it with a finger inserted into the hole, and also enabling the user to detect whether a sheet of photographically sensitised material is present in the holder or not.

The number of holders in the device is preferably from 6 to 10 most preferably 9.

In use, the device is first loaded with sheets of photographically sensitised material as follows:

The device is placed with its axis vertical and all the holders swung out from the frame so as to present their concave arcuate surfaces. A sheet of photographically sensitised paper is then placed in position on each holder and that holder swung in together with all the other holders so that they form a series of overlapped arcuate holders the envelope of the exterior surfaces of which is a circle of diameter slightly smaller than the internal diameter of a drum processor with which the device is to be used. With the loaded device folded up in this way, it is inserted axially into a drum processor and the processor then used in the usual way. Care should be taken that the processor is rotated in such a fashion that the holders scoop up processing liquid from the bed of liquid in the bottom of the drum as the drum is rotated.

It is found that a three-fold improvement in the capacity of a processing drum may be easily and simply obtained by using the device according to the present invention.

By way of example a processor insert according to the present invention is illustrated in the accompanying drawings in which.

Figure 1:
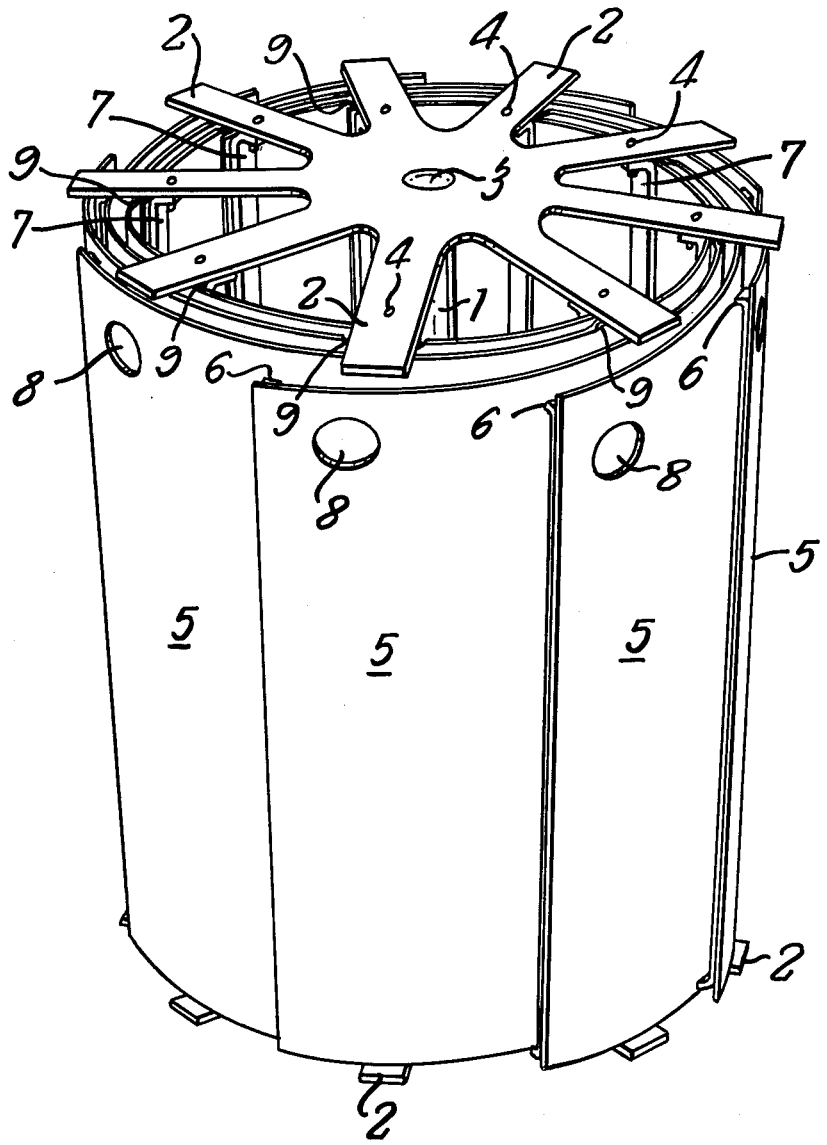
FIG. 1 is a perspective view of a processor insert according to the present invention from above and slightly to one side.
Figure 2:
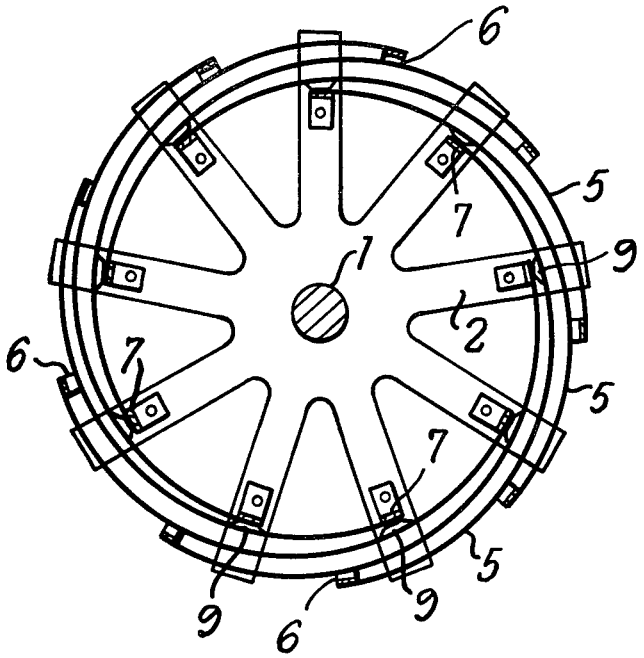
FIG. 2 is a section across the insert of FIG. 1 with the device "folded up.
Figure 3:
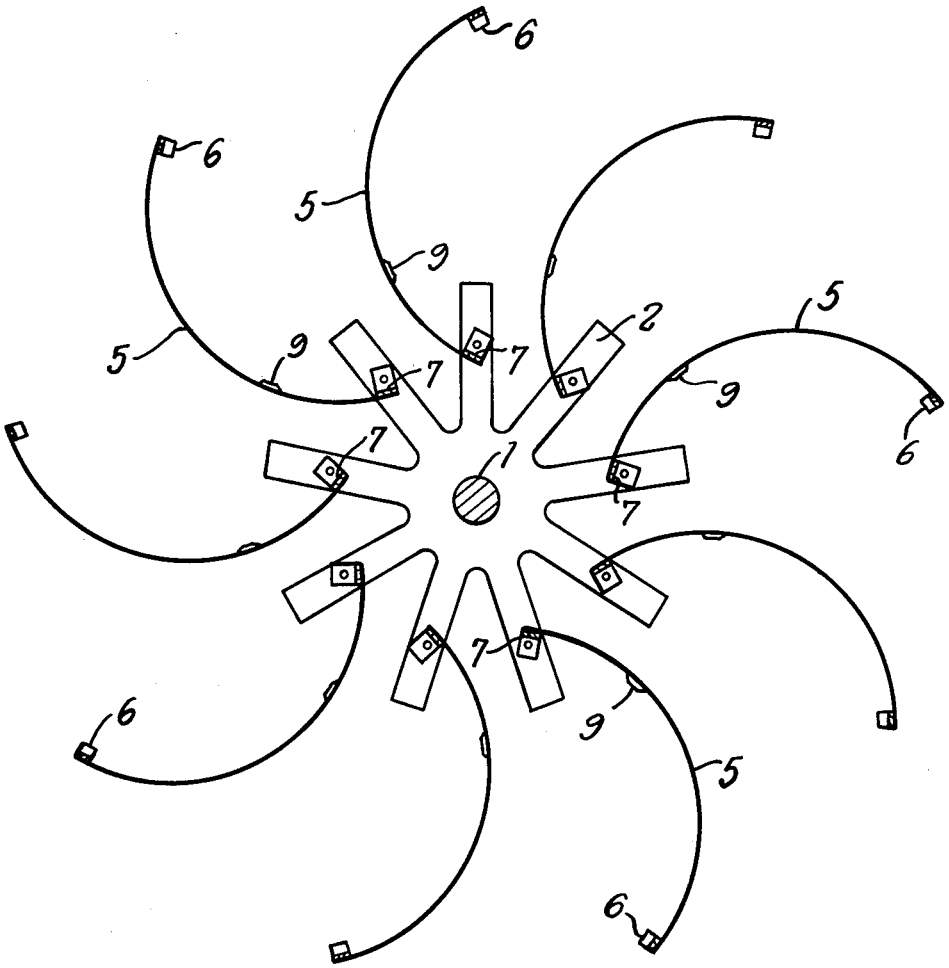
" and FIG. 3 is a cross section with the device unfolded.

Referring to the drawings the device consists of a central frame formed of a shaft 1 two end spiders 2. One end of shaft 1 has a dimple 3 for a purpose to be explained below Each of the nine arms of spider 2 bears an inwardly directed pin 4, the pins on one spider being of a larger diameter than the pins on the other.

Pivotally mounted between the spiders are nine arcuate holders 5. Each of these consists of a part cylindrical base bearing along its edges a bar 6 and a bar 7. Bar 6 has slightly upturned ends which serve in use to space it from the next adjacent holder 5 while bar 7 has longer upturned ends each of which has an aperture in which one of the pins 4 engages. One of the apertures in bar 7 is larger than the other corresponding to the differences in the sizes of pins 4.

Each holder 5 also has a through hole 8 as shown. This serves two purposes: first it enables easier removal of a sheet from the holder by passing a finger through the hole, and also it enables the presence or otherwise of a sheet of photographic material in the holder to be felt from outside the closed device as shown in FIG. 1. In addition, the edge of each holder 5 is bent at 9, both to serve as a further abutment on the next adjacent holder 5, and to serve as an end stop aiding in locating and securing the sheet in the holder.

Each holder 5 can be removed from or replaced in the frame by flexing apart its respective arms of the spider 2 so that pins 4 come out of the holes in the ends of bar 7. If all holders 5 are removed, it is impossible to put them back the other way round relative to the frame because of the different sizes of pins 4. Accordingly, seen from the end of the frame having the dimple 3, the holders 5 will act as a scoop if the device is rotated clockwise, with the axis of shaft 1 horizontal. Thus, when the device loaded with photographically sensitised material is placed in a processing drum, provided the end of shaft 1 remote from the dimple is always introduced into the drum first and provided the drum is always rotated the same way, it is ensured that the device is rotated in the correct direction during use. It will be seen that if the device is rotated the wrong way round in a drum processor, no satisfactory wetting of the pieces of photographically sensitised material in the holders will be obtained and accordingly they will not be satisfactorily treated by the processing solution. In order to avoid this, it should be ensured that the processing drum is always turned the same way, the insert always placed in the same orientation in the drum and the holders 5 always placed the right way round on the frame. This last is ensured by the pins 4 being different sizes.

I claim:

1. A drum processor insert for use in a photographic drum processor, the insert comprising:

a frame comprising a central axially extending member, and, on each end of the member, a spider having a number of equiangularly spaced arms, a plurality of arcuate holders each adapted to hold a sheet of photographically sensitised material, each arm of each spider bearing a pivot and each holder being swingably mounted about an axis between two such pivots on oppositely facing arms, all such axes being parallel and being parallel to the straight edges of the arcuate holder, and each arm of each spider being resilient so that two opposite arms may be sprung apart to release a swingable holder held between them, each holder being swingable from a closed position in which the frame and holders constitute a substantially cylindrical shape, the holders overlapping each other and the straight edges of the holders being distributed about the periphery of the cylinder, and an open position in which the face of each holder adapted to receive a sheet of photographically sensitised material can be reached.

2. The drum processor insert of claim 1 wherein one end of the frame bears means identifying it from the other end of the frame.

3. The drum processor insert of claim 1 wherein the frame comprises means to ensure that the holders may be demounted from and remounted on the frame in only one orientation.

4. The drum processor insert of claim 1 wherein each holder consists of a substantially cylindrical trough having at either side a holding strip.

5. The drum processor insert of claim 1 wherein the ends of each arcuate holder comprise means to prevent a sheet of photographically sensitised material slipping out axially from the holder.

6. The drum processor insert of claim 1 wherein each arcuate holder comprises a plate having at least one through hole against which a sheet of photographically sensitised material in the holder lies.

7. The drum processor insert of claim 1 and including six to ten holders.

8. The drum processor insert according to claim 1 and having nine holders.

* * * * *